US008844840B2

(12) United States Patent
Lawrence

(10) Patent No.: US 8,844,840 B2
(45) Date of Patent: Sep. 30, 2014

(54) PAINT SPRAYER WITH PAINT CONTAINER ATTACHMENT APPARATUS

(75) Inventor: Bobby Lynn Lawrence, Palmetto, FL (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 523 days.

(21) Appl. No.: 13/330,893

(22) Filed: Dec. 20, 2011

(65) Prior Publication Data

US 2013/0153683 A1 Jun. 20, 2013

(51) Int. Cl.

| | |
|---|---|
| ***B05B 9/043*** | (2006.01) |
| ***B05B 9/03*** | (2006.01) |
| ***B05B 9/01*** | (2006.01) |
| ***B65D 53/02*** | (2006.01) |
| ***B65D 51/00*** | (2006.01) |

(52) U.S. Cl.

USPC ..... 239/333; 239/526; 239/600; 220/212; 220/238; 220/700; 220/701

(58) Field of Classification Search

USPC ..... 239/302, 329, 330, 332, 333, 525, 526, 239/600, DIG. 14; 220/212, 212.5, 233, 220/234, 238, 288, 293, 319, 694, 695, 697, 220/699, 700, 701, 755, 756, 759; 215/329, 215/332

See application file for complete search history.

(56) References Cited

U.S. PATENT DOCUMENTS

| | | | | |
|---|---|---|---|---|
| 1,272,438 | A | 7/1918 | Heinrich | |
| 1,583,927 | A * | 5/1926 | Hersler | 222/464.1 |
| 2,051,518 | A | 8/1936 | Cunningham | |
| 2,263,842 | A * | 11/1941 | Gross | 220/324 |
| 2,670,882 | A * | 3/1954 | Best | 222/464.1 |
| 2,888,207 | A | 5/1959 | Sykes | |
| 3,858,810 | A * | 1/1975 | Seeley et al. | 239/121 |
| 4,351,449 | A * | 9/1982 | Zobel | 220/318 |
| 4,540,301 | A | 9/1985 | Swanson et al. | |
| 4,639,156 | A | 1/1987 | Stern et al. | |
| 4,824,018 | A | 4/1989 | Shreve | |
| 5,161,689 | A | 11/1992 | Balson | |
| 5,209,365 | A * | 5/1993 | Wood | 220/212 |
| 5,655,714 | A * | 8/1997 | Kieffer et al. | 239/318 |
| 6,701,975 | B1 | 3/2004 | Neal | |
| 6,712,292 | B1 | 3/2004 | Gosis et al. | |
| 2005/0128870 | A1 * | 6/2005 | Garcia | 366/347 |
| 2006/0131446 | A1 * | 6/2006 | Vicentini | 239/526 |
| 2006/0196891 | A1 * | 9/2006 | Gerson et al. | 222/386.5 |
| 2007/0221753 | A1 * | 9/2007 | Gohring et al. | 239/340 |
| 2009/0050712 | A1 * | 2/2009 | Vitantonio et al. | 239/332 |
| 2009/0108089 | A1 * | 4/2009 | Handzel et al. | 239/8 |
| 2011/0240763 | A1 * | 10/2011 | Svendsen et al. | 239/332 |
| 2011/0240764 | A1 * | 10/2011 | Sandahl | 239/332 |

* cited by examiner

*Primary Examiner* — Darren W Gorman
(74) *Attorney, Agent, or Firm* — Jones Day

(57) ABSTRACT

A paint sprayer is configured for use with a paint container. The sprayer includes a housing having an air inlet and a nozzle located on the housing. Movable grip members are supported on the housing. The grip members are located in a circular array with an inner diameter that is greater than the outer diameter of the paint container. A ring extends circumferentially about the circular array of grip members, and is supported on the housing for rotation relative to the housing. When the ring rotates relative to the housing, it moves the grip members to a condition in which the inner diameter of the circular array is not greater than the outer diameter of the paint container.

32 Claims, 17 Drawing Sheets

PAINT SPRAYER WITH PAINT CONTAINER ATTACHMENT APPARATUS

TECHNICAL FIELD

This technology relates to a pneumatically operated paint sprayer.

BACKGROUND

A sprayer for paint has a nozzle and a trigger. The sprayer is connected to an air hose, and a container of paint is mounted on the sprayer. When the user depresses the trigger, the force of the pressurized air moves a piston that pumps the paint from the container into the sprayer, and sprays the paint outward from the nozzle.

SUMMARY OF THE INVENTION

A paint sprayer is configured for use with a paint container. The sprayer includes a housing with an air inlet, and a nozzle located on the housing. Movable grip members are supported on the housing. The grip members are located in a circular array with an inner diameter that is greater than the outer diameter of the paint container. A ring extends circumferentially about the circular array of grip members, and is supported on the housing for rotation relative to the housing. When the ring rotates relative to the housing, it moves the grip members to a condition in which the inner diameter of the circular array is not greater than the outer diameter of the paint container. In a preferred embodiment, the ring is further configured to press the grip members radially inward against the cylindrical outer surface of the paint container upon rotating relative to the housing.

DETAILED DESCRIPTION

Figure 1:
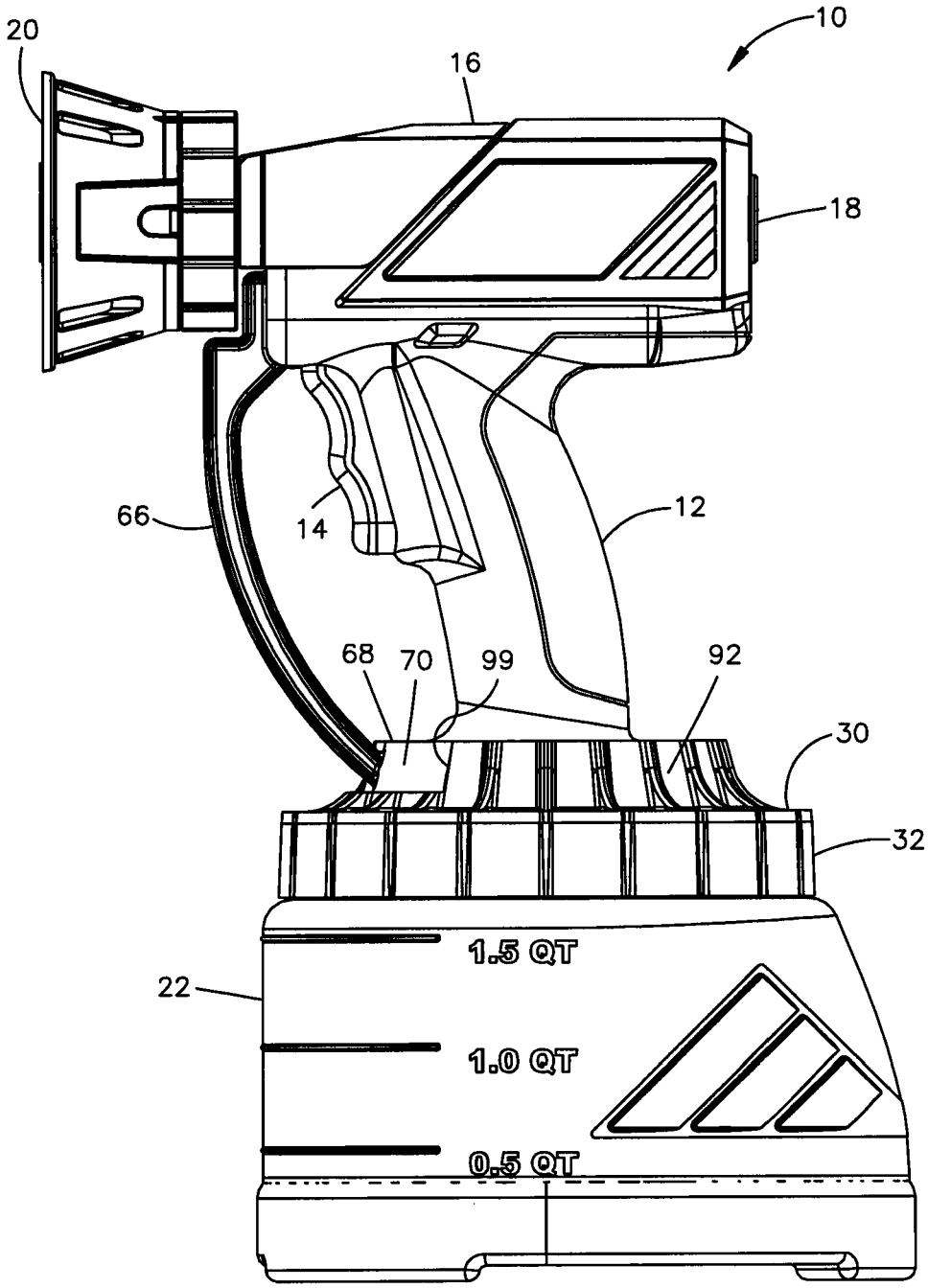
FIG. 1 is a side view of a paint sprayer with an attached paint container.

A paint sprayer 10 is shown in FIG. 1. In this embodiment, the paint sprayer 10 is a hand-held device with a handle 12 and a trigger 14. The handle 12 is configured as a pistol grip, and is part of a housing 16. The housing 16 contains an air motor that receives pressurized air from a hose connected to an inlet 18 at the rear end of the housing 16. A nozzle 20 is located at the front end of the housing 16, and a paint container 22 is mounted on the housing 16 at the lower end of the handle 12. The housing 16 also contains a fluid pump that is driven by the air motor to prime and spray paint from the container 22 outward through the nozzle 20.

Upper and lower rings 30 and 32 also are supported on the housing 16 at the lower end of the handle 12. The rings 30 and 32 cooperate with the housing 16 such that rotating the rings 30 and 32 relative to each other in a first direction grips and secures the paint container 22 to the housing 16, and rotating the rings 30 and 32 relative to each other in the opposite direction releases the paint container 22 from the housing 16.

Figure 2:
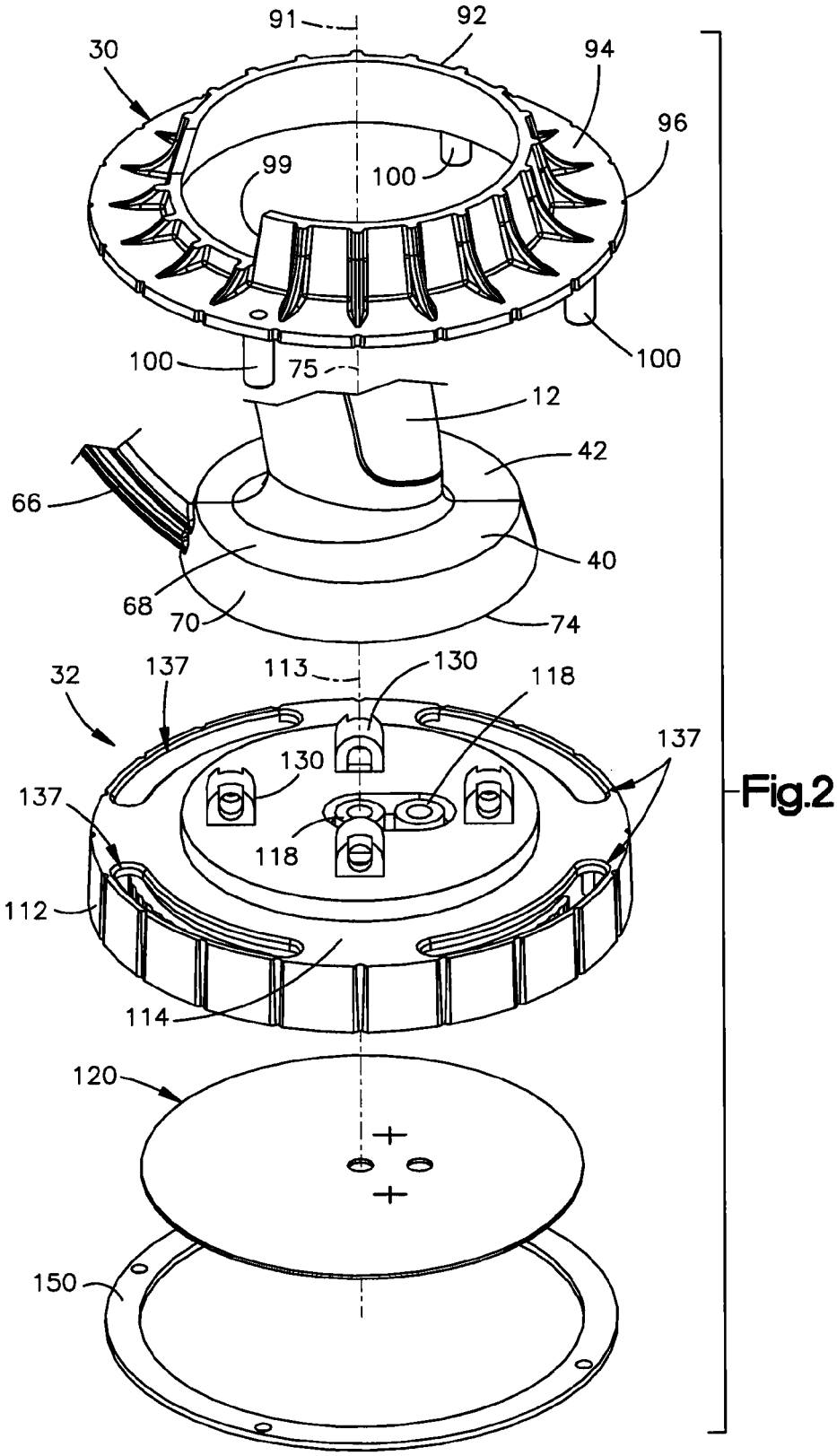
FIG. 2 is an exploded view of parts shown in FIG. 1.
Figure 3:
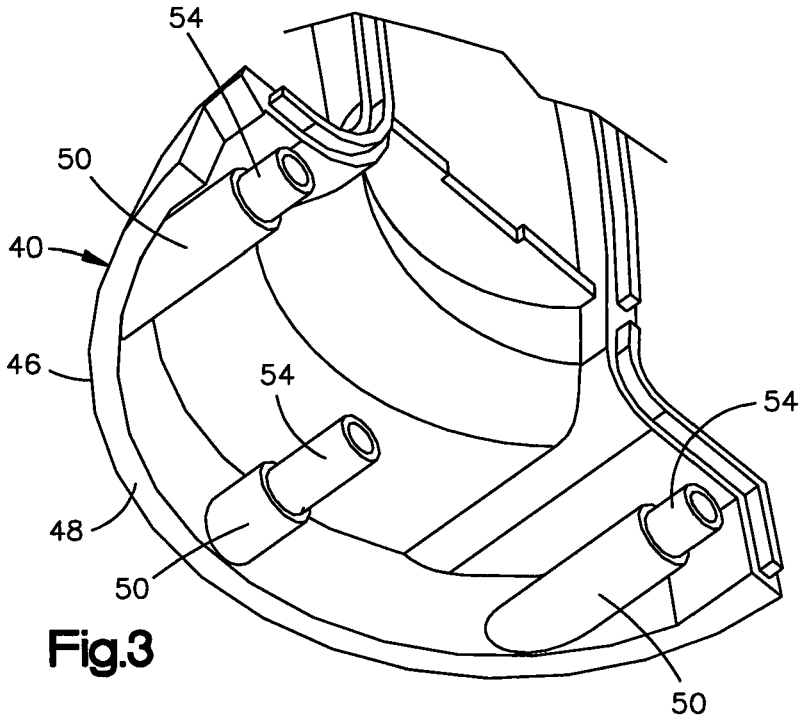
FIG. 3 is a lower perspective view of a part shown in FIG. 2.
Figure 4:
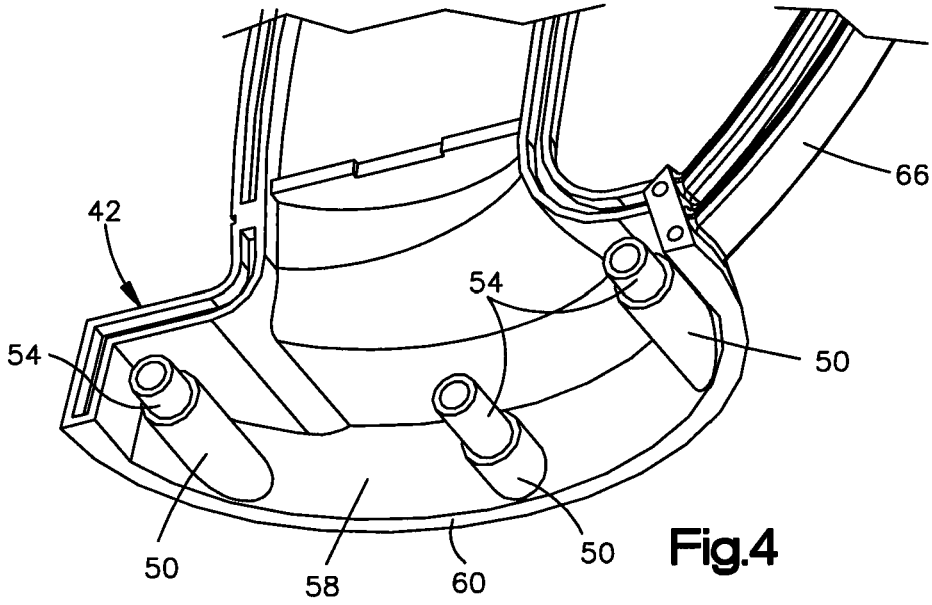
FIG. 4 is a lower perspective view of another part shown in FIG. 2.

As shown partially in FIG. 2, the handle 12 has right and left side parts 40 and 42. As viewed from below in FIG. 3, the right side part 40 has a semi-circular wall 46 with a bottom edge 48. Three cylindrical pegs 50 project from the wall 46 across the inside of the handle 12. Each peg 50 has an outer end portion 54 with a reduced diameter. As viewed from below in FIG. 4, the left side part 42 also has a semi-circular wall 58 with a bottom edge 60 and three cylindrical pegs 50 projecting across the inside of the handle 12. Each of those pegs 50 also has a lesser diameter outer end portion 54. The left side part 42 of the handle 12 further includes a trigger guard 66.

When the two side parts 40 and 42 are joined together as shown in FIG. 2, they define a short, cylindrical base portion 68 of the handle 12 with a tapered side surface 70. The bottom edges 48 and 60 (FIGS. 3 and 4) together define a circular, open lower end 74 of the handle 12 which is centered on a vertical axis 75.

Figure 5:
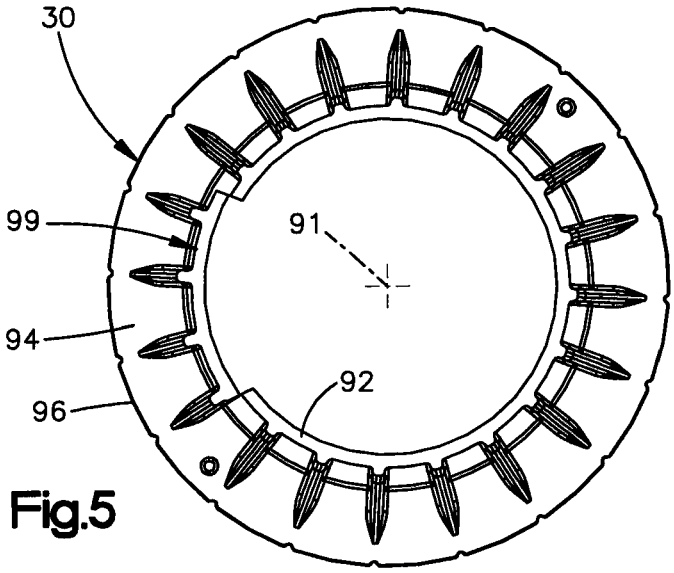
FIG. 5 is a top view of a part shown in FIG. 2.
Figure 6:
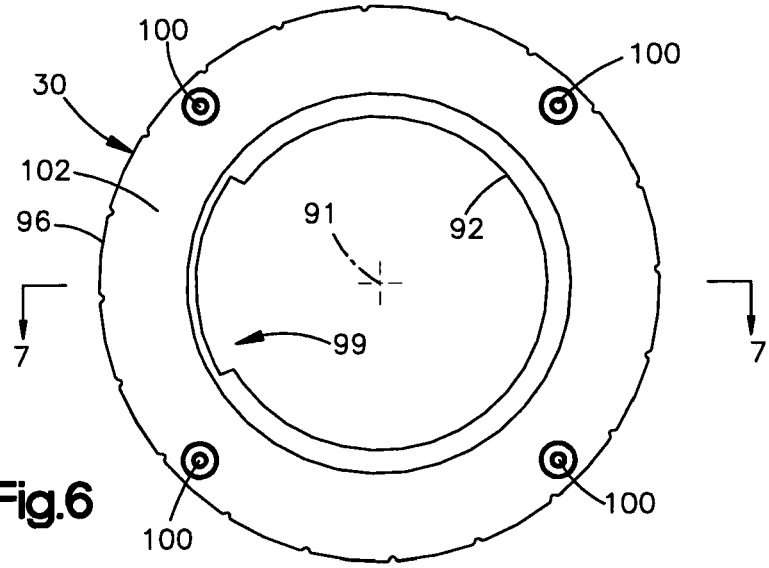
FIG. 6 is a bottom view of the part shown in FIG. 5.
Figure 7:
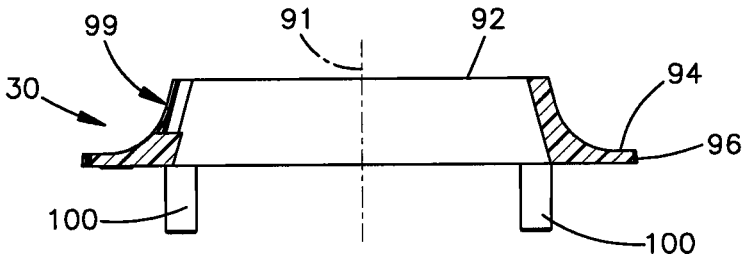
FIG. 7 is a sectional view taken in line 7-7 of FIG. 6.

As shown separately in FIGS. 5-7, the upper ring 30 has a circular shape centered on an axis 91. A cylindrical wall portion 92 of the upper ring 30 is located at the upper side 94 of a flat annular flange portion 96. The wall 92 tapers radially inward as it projects upward from the flange 96. A cutout 99 for the trigger guard 66 extends partly around the circumference of the wall 92. Four cams 100 are located at the lower side 102 of the flange 96. In the preferred embodiment, the cams 100 are configured as posts that project axially downward from the lower side 102 of the flange 96 at locations that are equally spaced apart in a circular array centered on the axis 91.

Figure 8:
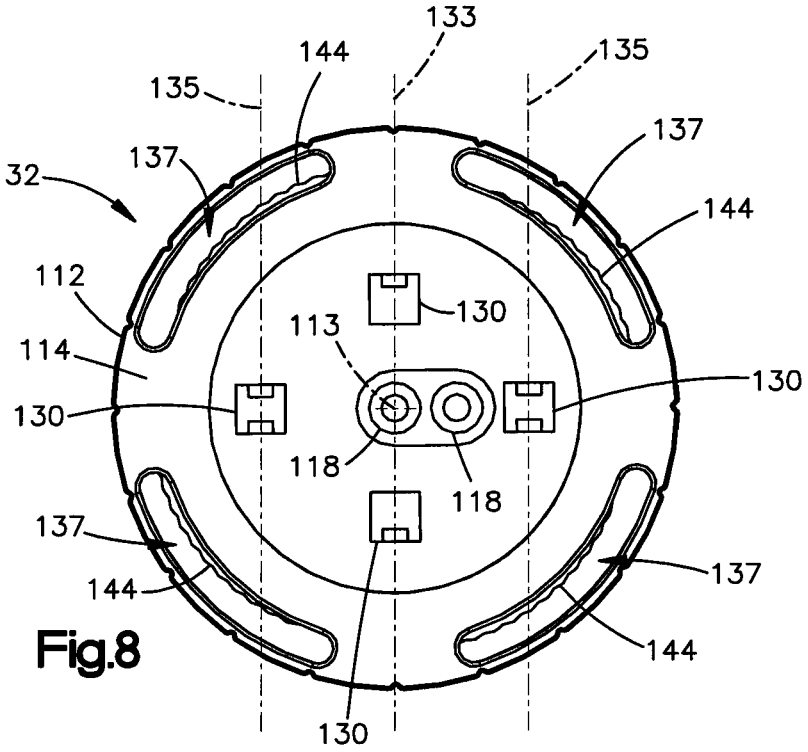
FIG. 8 is a top view of another part shown in FIG. 2.
Figure 9:
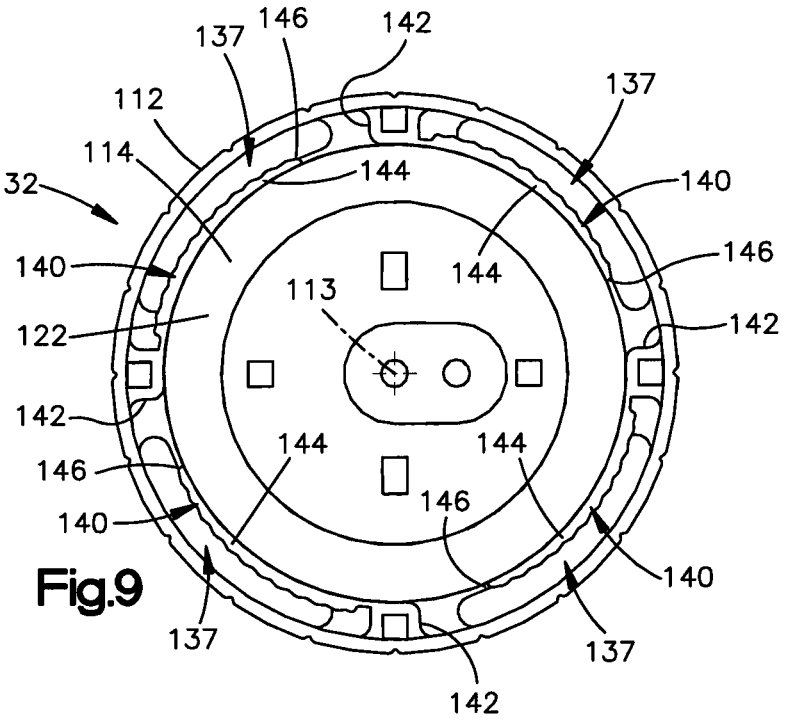
FIG. 9 is a bottom view of the part shown in FIG. 8.

As shown in FIGS. 2 and 8-9, the lower ring 32 has a cylindrical side wall 112 centered on an axis 113. A circular end wall 114 reaches across the upper end of the side wall 112. Tubular portions 118 of the end wall 114 provide access passages for paint siphon and return lines to reach through the lower ring 32 between the housing 16 and the paint container 22. A gasket 120 (FIG. 2) fits against an annular lower side surface 122 of the end wall 114, as shown in FIG. 10.

Four mounting bosses 130 on the end wall 114 are arranged in two pairs. The first pair of mounting bosses 130 have passages centered on a line 133 extending diametrically across the top of the end wall 114. The other pair of mounting bosses 130 have passages centered on offset lines 135 that are parallel to the diametrical line 133. Four arcuate slots 137 extend through the end wall 114. The slots 137 are arranged in a circular array centered on the axis 113, and are equally spaced apart from each other around the circumference of the end wall 114.

Figure 10:
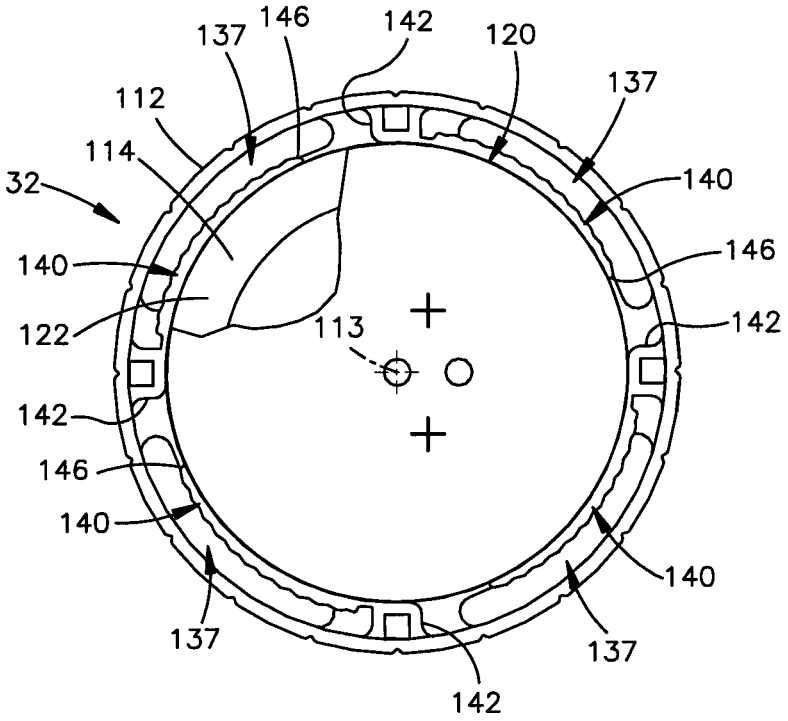
FIG. 10 is a view similar to FIG. 9, showing an additional part.
Figure 11:
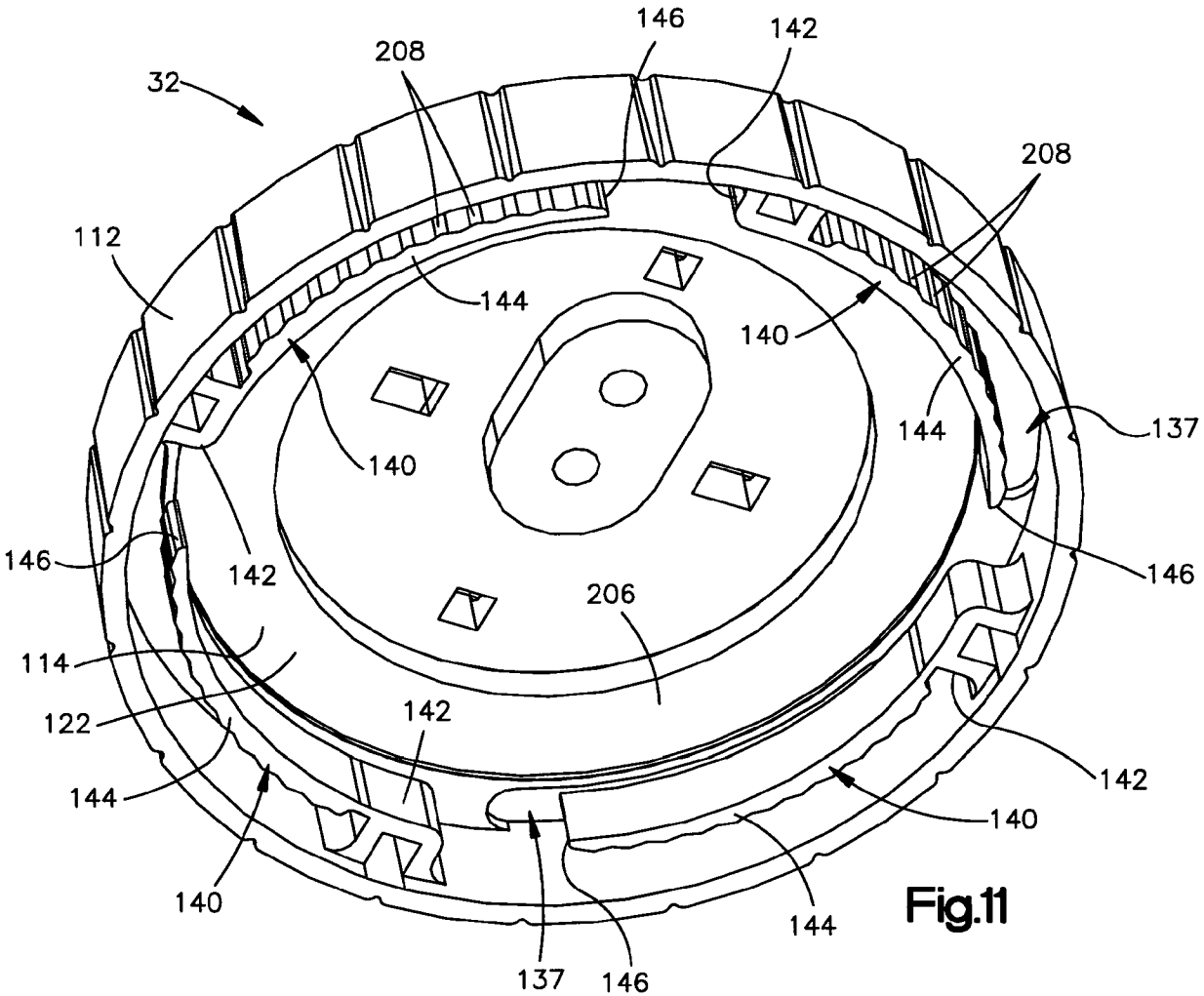
FIG. 11 is a lower perspective view of the part shown in FIGS. 8 and 9.

As shown in the bottom views of FIGS. 9-11, four grip members 140 are located on the lower ring 32 in a circular array beneath the four slots 137. In the preferred embodiment, the grip members 140 are alike, with each having a base 142 and an arm 144. Each base 142 projects radially inward from the side wall 112 between a pair of the slots 137. Each arm 144 projects from the respective base 142 to a free end 146. Specifically, each arm 144 has an elongated arcuate shape extending circumferentially alongside an adjacent slot 137. The length of each arm 144 reaches nearly to the opposite end of the slot 137. In this configuration, the arm 144 of each grip member 140 is pivotally deflectable radially about the base 142. Additionally, the thickness of each arm 144 decreases progressively along its length in a direction from the base 142 toward the free end 146, which is clockwise in the view of FIG. 9. This provides a space between the arm 140 and the side wall 112 that narrows progressively in the opposite direction, which is counterclockwise in FIG. 9.

The upper and lower rings 30 and 32 are supported on the handle 12 as shown in FIG. 1. When the side parts 40 and 42 are brought together to form the base portion 68 of the handle 12, each peg 50 on the right side part 40 is aligned with a corresponding peg 50 on the left side part 42. The outer end portions 54 of the pegs 50 are received in the mounting bosses 130 on the end wall 114 of the lower ring 32. The pegs 50 thus capture the end wall 114 within the handle base 68, and block the lower ring 32 from rotating relative to the handle 12.

Figure 12:
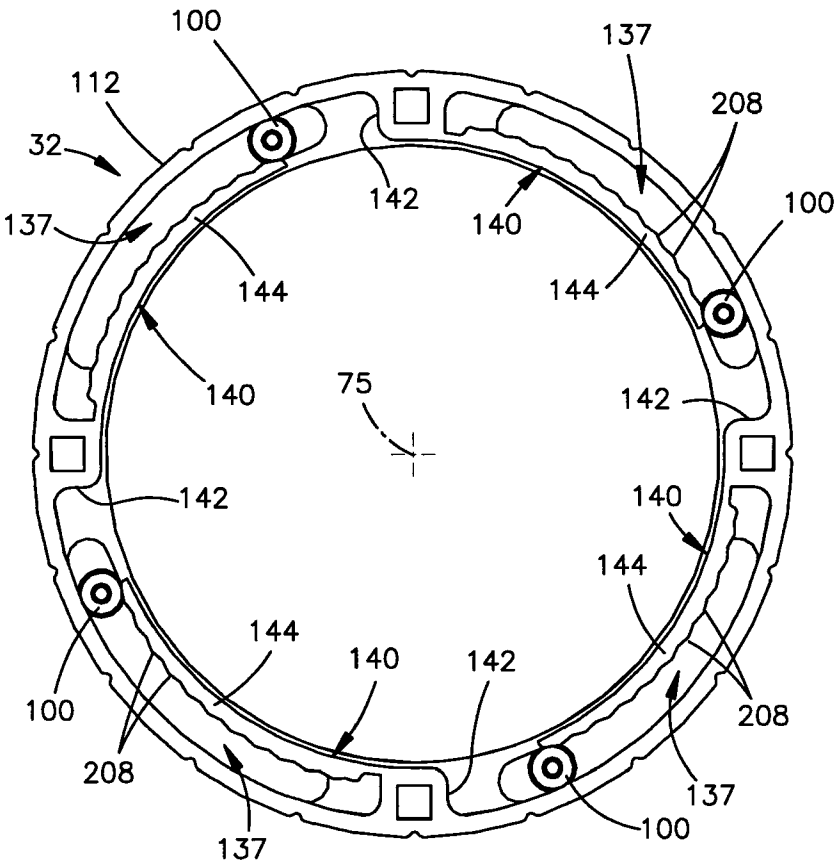
FIG. 12 is a partial view of the parts shown in FIGS. 6 and 9.

The upper ring 30 is received coaxially over the handle base 68, with the wall 92 on the ring 30 overlaying the tapered side surface 70 of the base 68. The cams 100 on the upper ring 30 project downward through the slots 137 in the lower ring 32. As shown in FIG. 12, the cams 100 are received radially between the side wall 112 of the lower ring 32 and the arms 144 of the grip members 140. A closure ring 150 (FIG. 2) interconnects the cams 100 at their lower ends, and supports the lower ring 32 vertically beneath the upper ring 30.

The upper ring 30 is rotatable about the vertical axis 75 relative to the handle 12 and the lower ring 32. The cutout 99 provides a range of clearance for the wall 92 on the upper ring 30 to move circumferentially back and forth past the trigger guard 66. When the cams 100 on the upper ring 30 move circumferentially back and forth relative to the grip members 140, they cause the arms 144 of the grip members 140 to move radially back and forth. For example, when the cams 100 move counterclockwise in FIG. 12, they move farther into the progressively narrower spaces between the arms 144 and the side wall 112 of the lower ring 32. This causes the cams 100 to deflect the arms 144 radially inward from the side wall 112. Return movement of the cams 100 in the clockwise direction enables the arms 144 to deflect elastically back outward.

Figure 13:
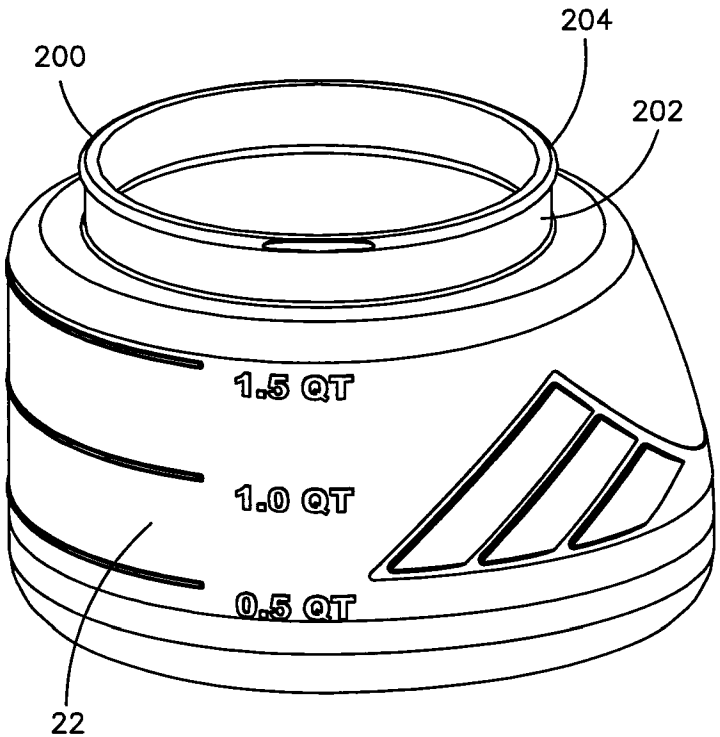
FIG. 13 is a perspective view of the paint container shown in FIG. 1.

As shown separately in FIG. 13, the paint container 22 has a neck 200 with a cylindrical outer surface 202. A top rim 204 on the neck 200 projects a short distance radially outward from the outer surface 202. When the arms 144 of the grip members 140 have an initial, unstressed condition as shown in FIG. 12, their circular array has an inner diameter that is greater than the outer diameter of the top rim 204. This enables the paint container 22 to be moved axially into the lower ring 32 toward and into an installed position in which the top rim 204 abuts the gasket 120 beneath the lower ring 32. The upper ring 30 can then be rotated to deflect the arms 144 from the unstressed condition to a stressed condition in which the arms 144 reach radially inward beneath the top rim 204. The arms then capture the neck 200 axially within the lower ring 32. Further rotation of the upper ring 30 can press the arms 144 firmly against the outer surface 202 of the neck 200. Ribs 208 on the arms 144 act as detents to hold the cams 100 in place, and may provide audible and tactile feedback to the user.

Figure 14:
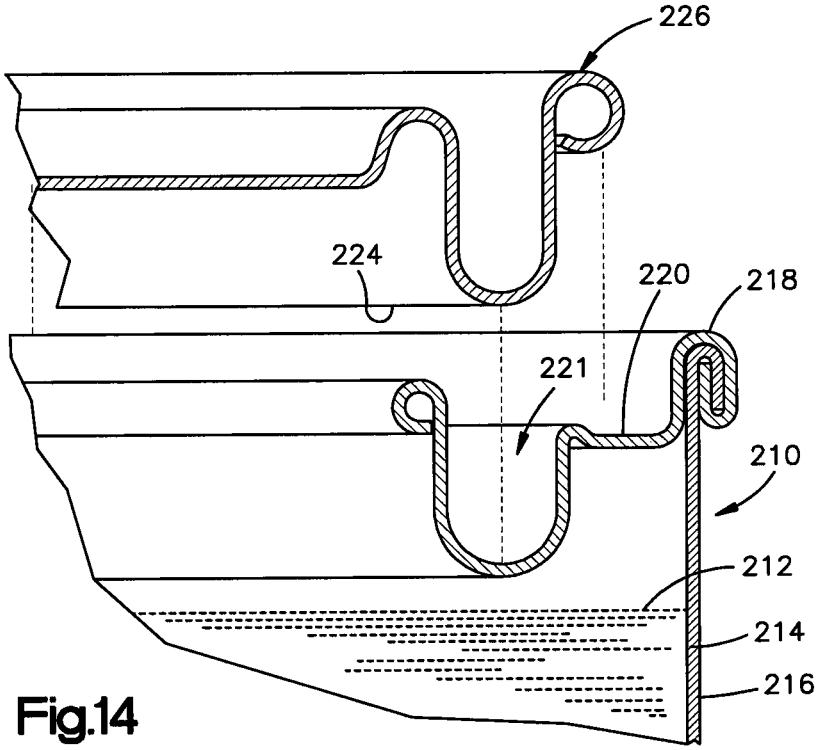
FIGS. 14 and 15 are partial sectional views of a paint can and a paint can lid.
Figure 15:
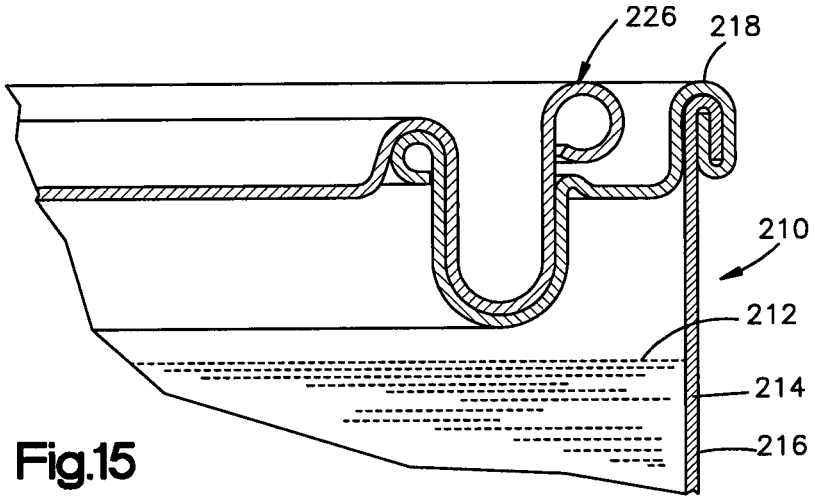

The paint sprayer 10 can also be used with an open can of paint instead of the paint container 22. As shown partially in FIGS. 14 and 15, such a can 210 of paint 212 typically has a side wall 214 with a cylindrical outer surface 216. A top rim 218 on the can 210 is formed in part by the side wall 214 and in part by an inner rim 220. The inner rim 220 has a sealing groove 221 for receiving a sealing bead 224 on a paint can lid 226. Like the container 22, the can 210 is movable axially into the lower ring 32 to an installed position in which the top rim 218 abuts the gasket 120 beneath the lower ring 32. The open can 210 of paint 212 can be captured in that position by rotating the upper ring 30 to deflect the arms 144 radially inward beneath the top rim 218, and preferably by pressing the arms 144 radially inward against the outer surface 216 of the side wall 214.

Figure 16:
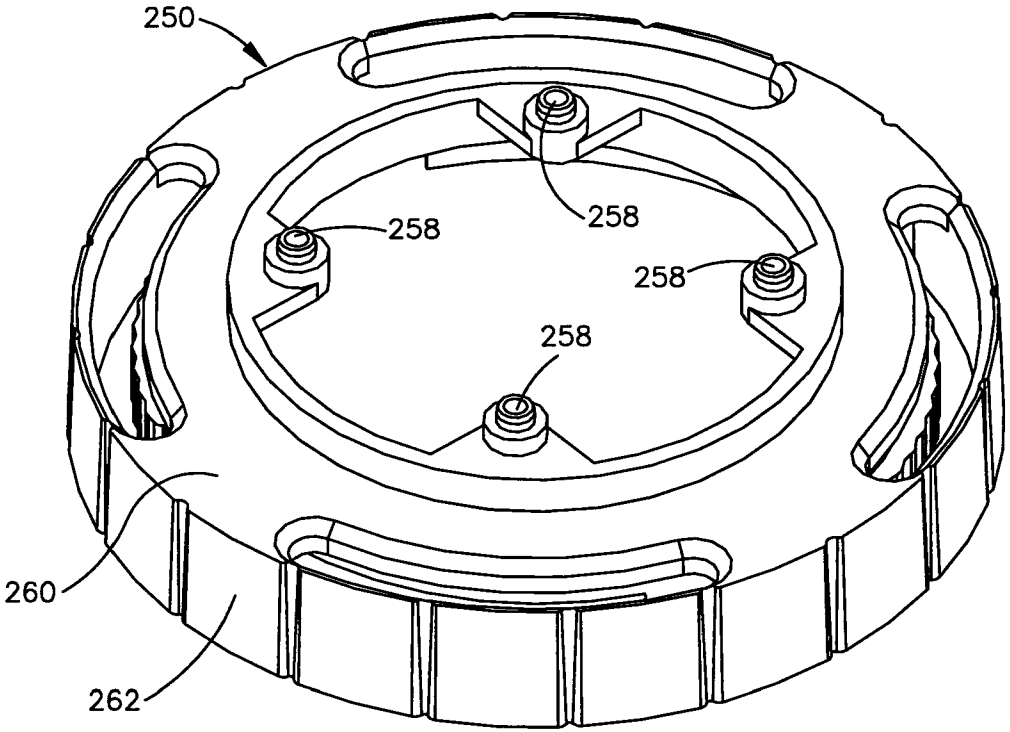
FIG. 16 is an upper perspective view of a part of a second embodiment of a paint sprayer.
Figure 17:
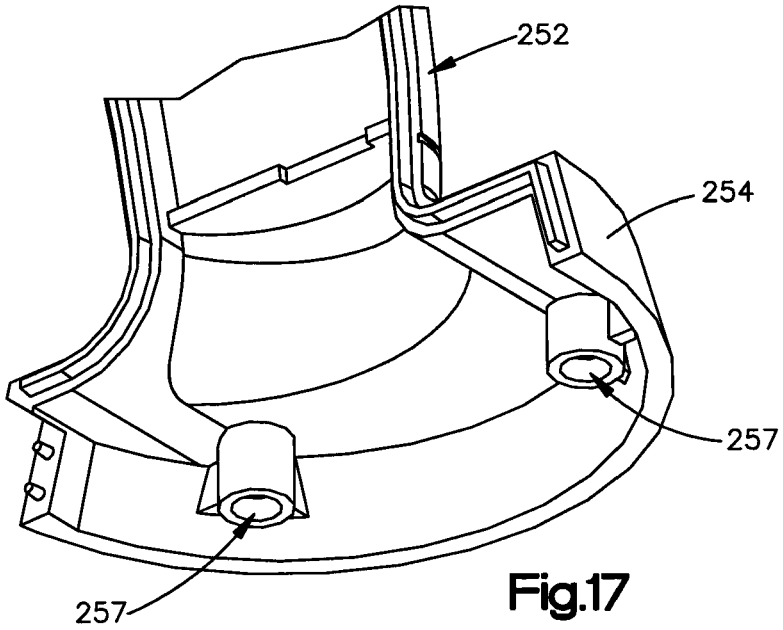
FIGS. 17 and 18 are lower perspective views of parts of the second embodiment.
Figure 18:
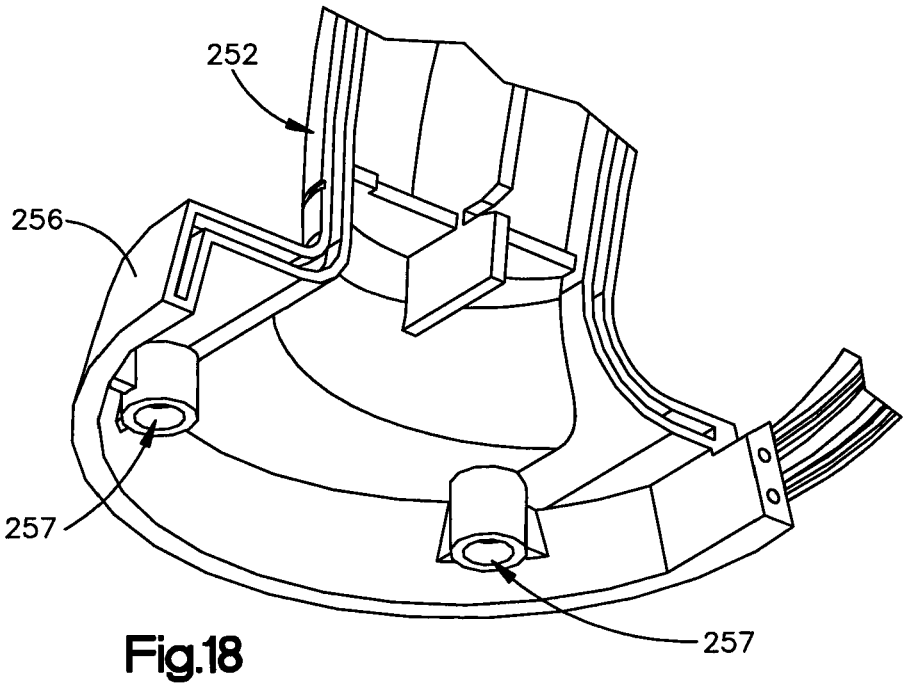
Figure 19:
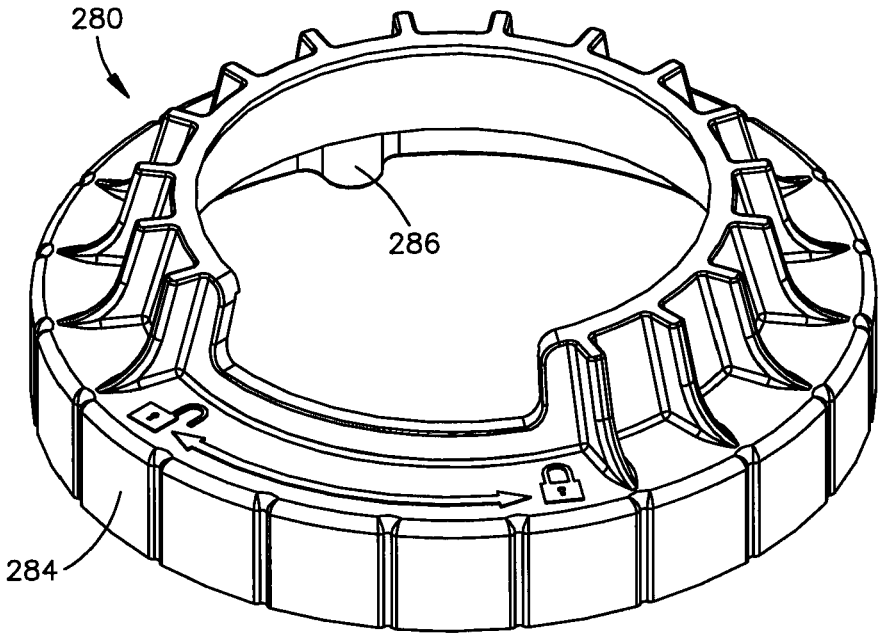
FIGS. 19 and 20 are upper and lower perspective views of a part of a third embodiment of a paint sprayer.
Figure 20:
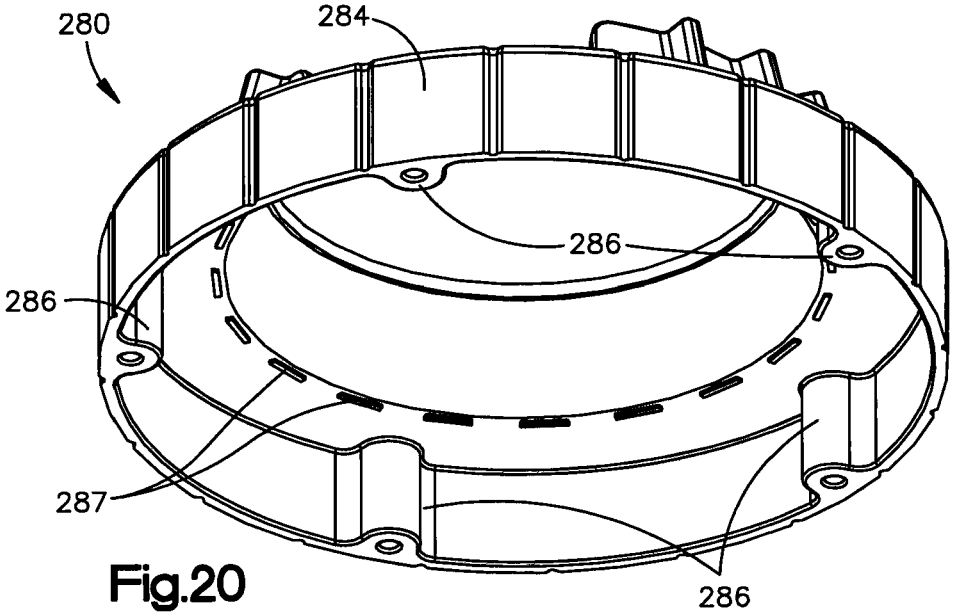
Figure 21:
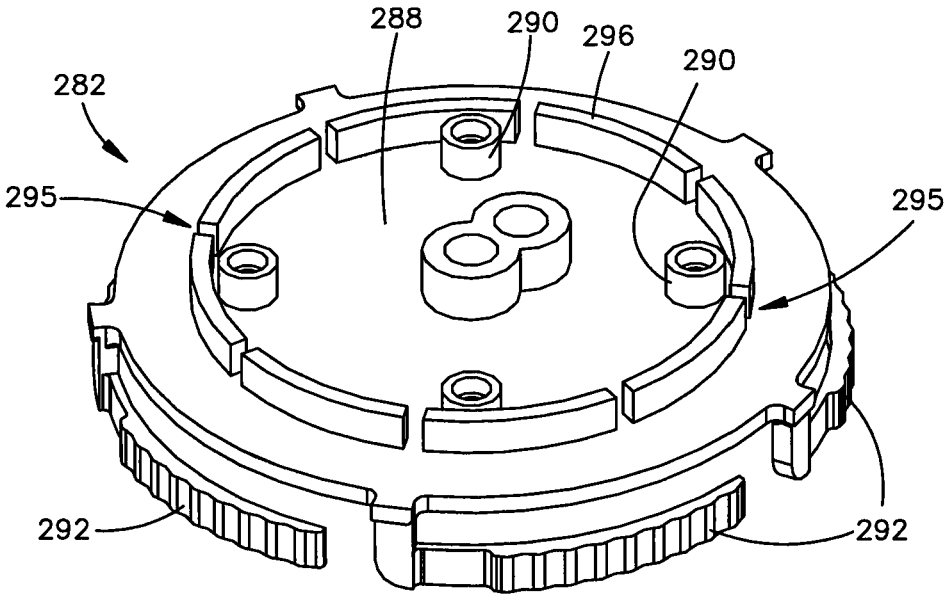
FIGS. 21 and 22 are upper and lower perspective views of a part of the third embodiment.
Figure 22:
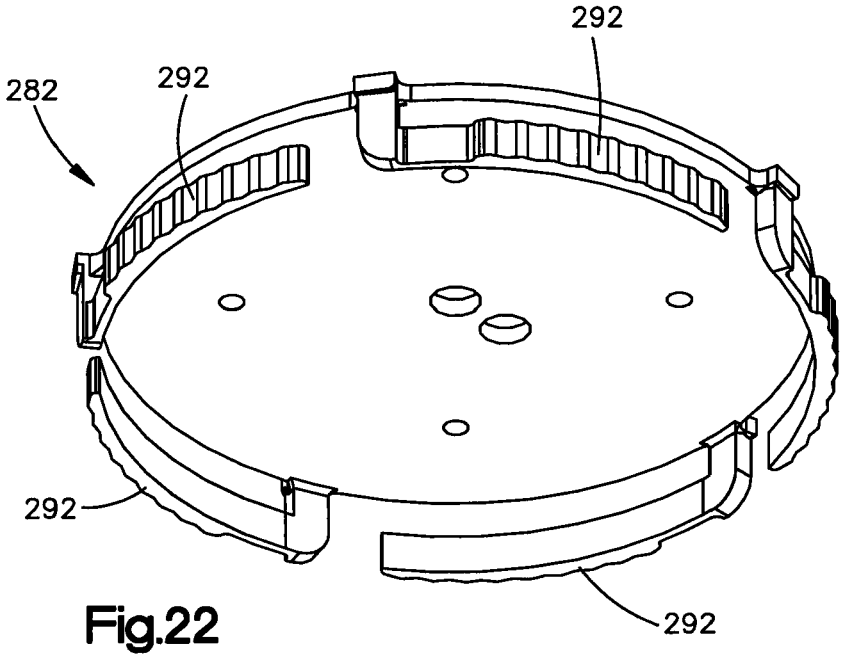

A second embodiment of the paint sprayer 10 has alternative parts shown in FIGS. 16-18, but is otherwise substantially the same as the first embodiment. These parts include a lower ring 250 and a housing 252 with left and right side parts 254 and 256. Each side part 254 and 256 of the housing 252 has a pair of bores 257 for receiving a corresponding pair of mounting bosses 258 on the lower ring 250. The mounting bosses 258 are located in an end wall 260 of the ring 250. Unlike the end wall 114 of the ring 32 described above, the end wall 260 of this ring 250 does not extend across the upper end of the respective side wall 262, but instead has an annular shape with an inner rim supporting the mounting bosses 258. The other parts of this ring 250 are substantially the same as the other parts of the ring 32 described above.

In a third embodiment, the paint sprayer 10 has the alternative upper and lower rings 280 and 282 shown in FIGS. 19-22. In this embodiment, the upper ring 280 has a side wall 284, whereas the other embodiments have side walls 112 and 262 on the lower rings 32 and 250. The cams 286 on the upper ring 280 adjoin the side wall 284. Ribs 287 at the underside of the upper ring 280 are spaced apart from each other in a circumferentially extending array.

The lower ring 282 in the third embodiment fits within the side wall 284 on the upper ring 280, and has an end wall 288 with mounting bosses 290 for securing to a housing. Grip members 292 on the lower ring 282, like the grip members 140 described above, secure a paint container in place under the influence of the cams 286. The lower ring 282 in the third embodiment further differs from the lower rings 32 and 250 in the first and second embodiments by having air flow slots 295 in a short cylindrical wall 296 atop the end wall 288.

Figure 23:
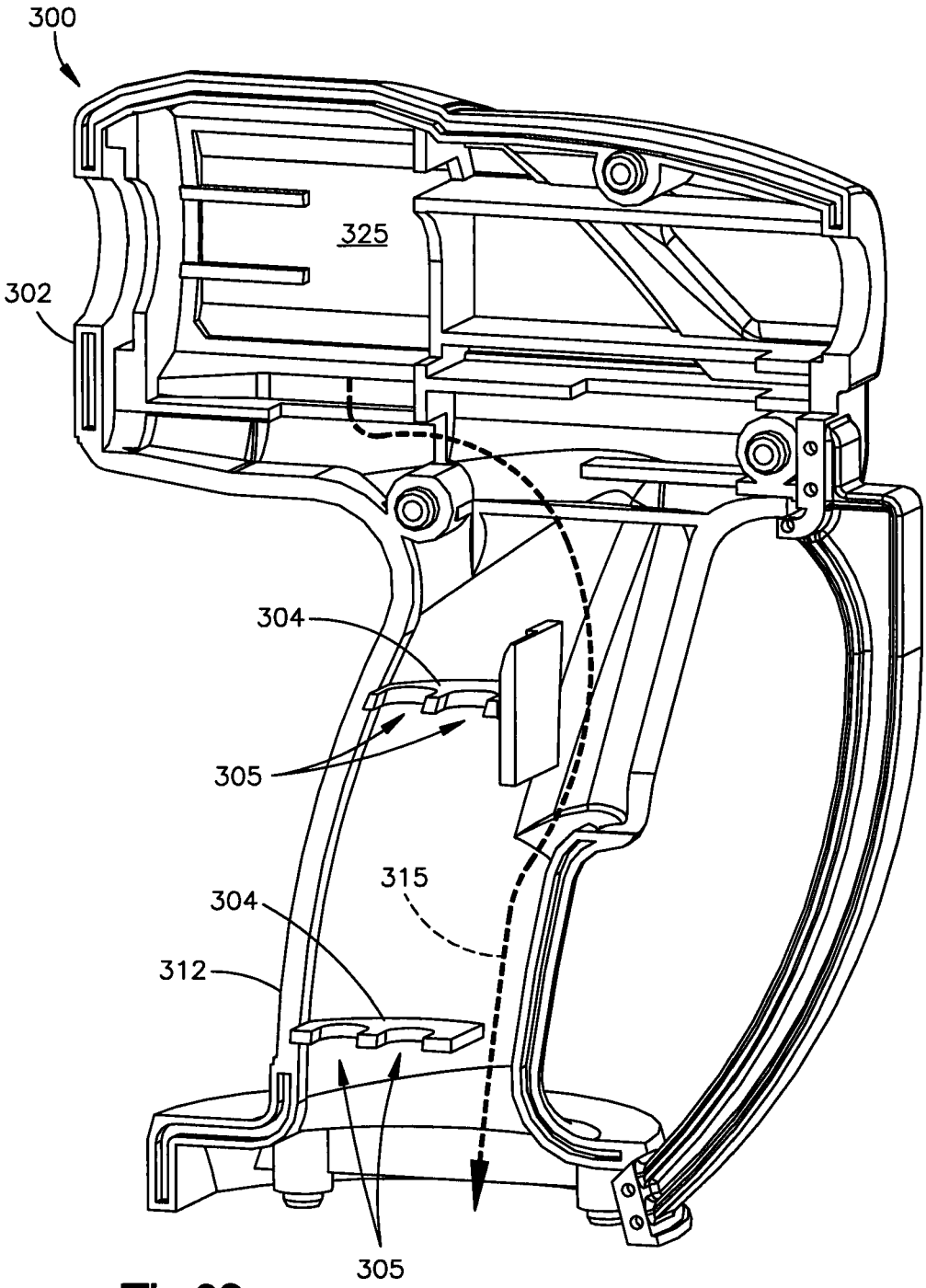
FIGS. 23 and 24 are side perspective views of other parts of the third embodiment.
Figure 24:
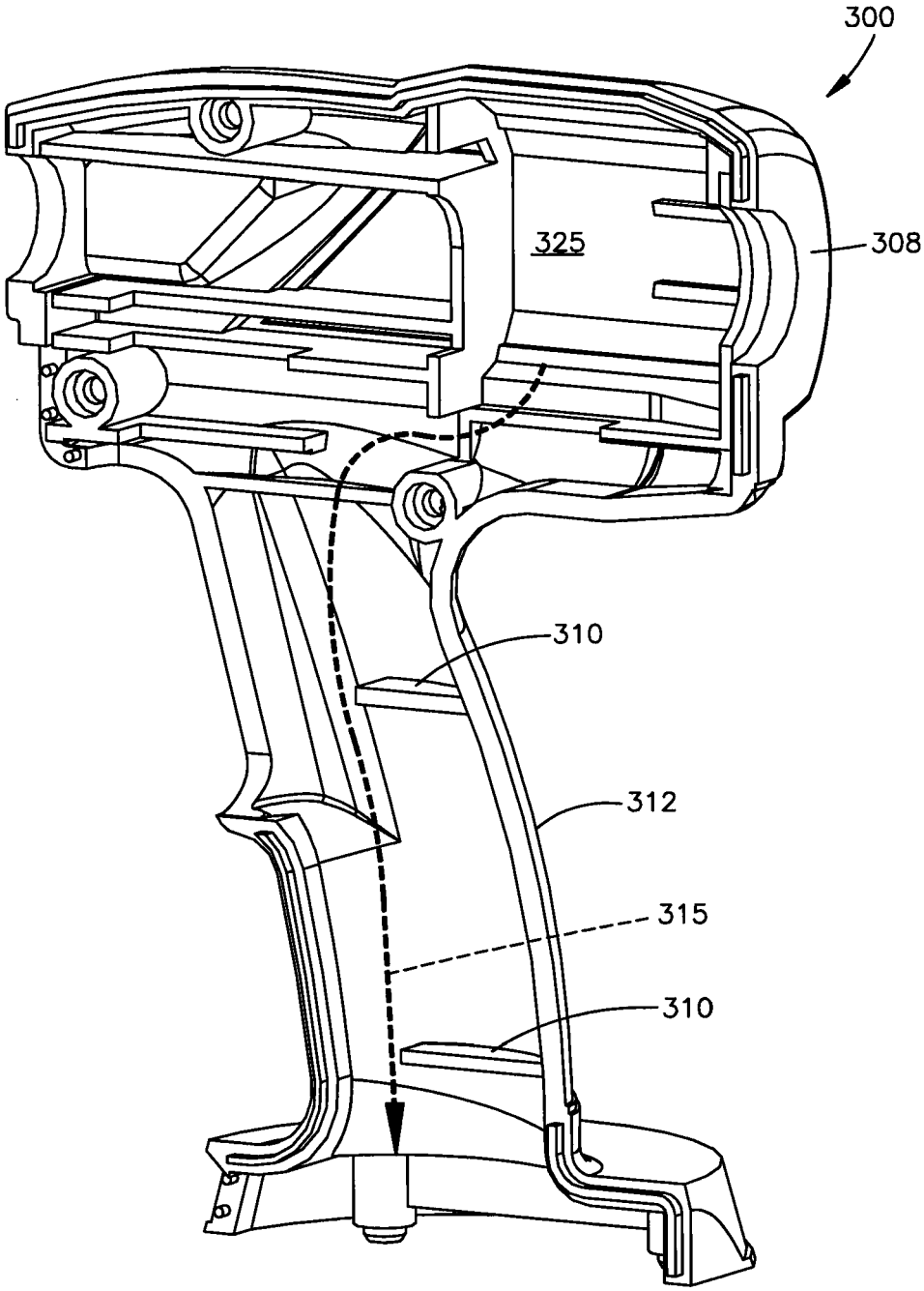

A housing 300 for the third embodiment of the paint sprayer 10 is shown in FIGS. 23 and 24. The left side part 302 (FIG. 23) of this housing 300 has internal ribs 304. Each rib 304 has a pair of notches 305 for receiving the paint siphon and return lines. Ribs 310 on the right side part 308 (FIG. 24) mate with the ribs 304 on the left side part 302 to capture the paint lines in the notches 305.

Figure 25:
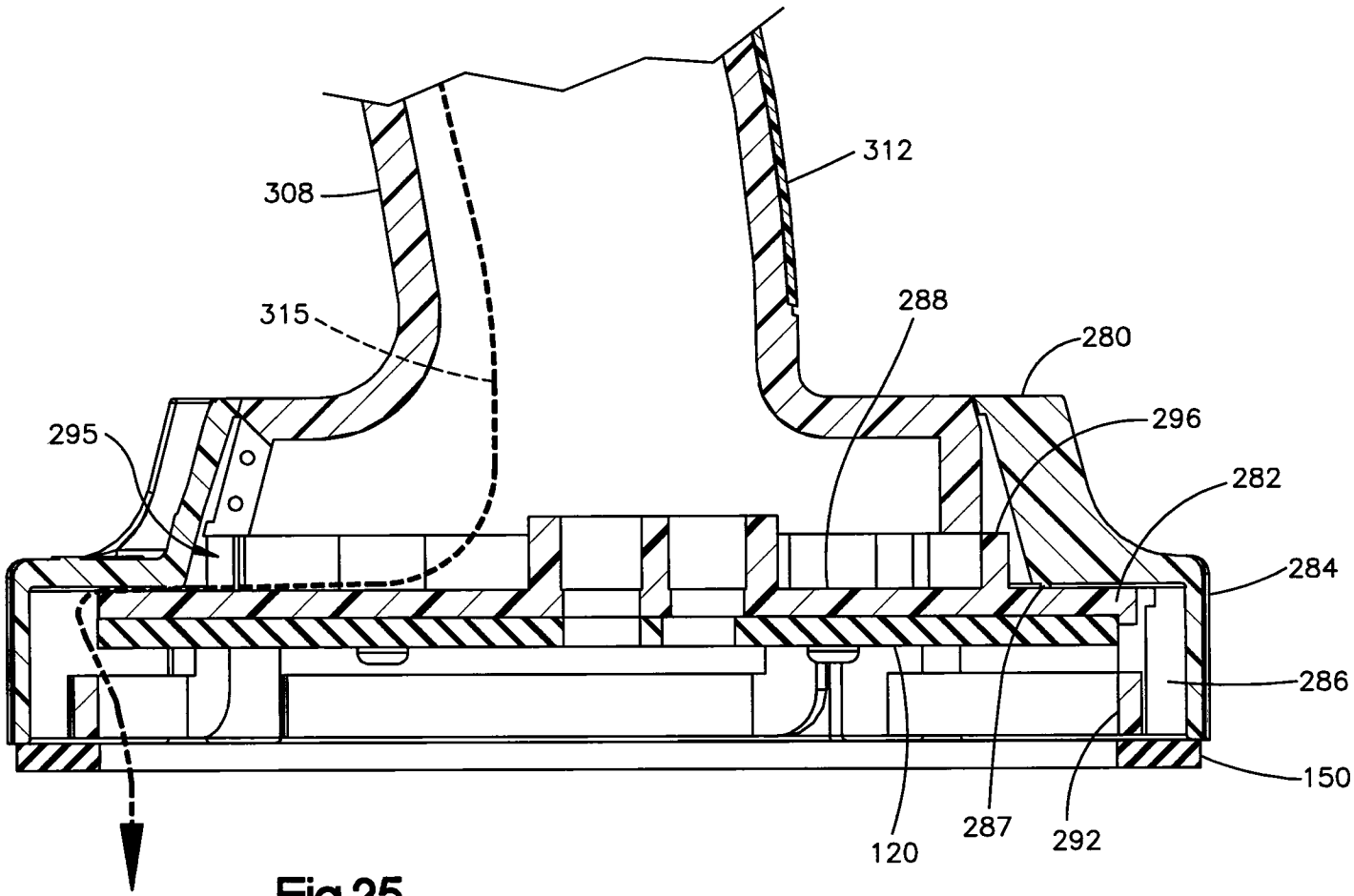
FIG. 25 is a partial sectional view of parts of the third embodiment.

The ribs 304 and 310 on the side parts 302 and 308 reach only partly across the handle portion 312 of the housing 300. This provides clearance for an air flow path 315. Specifically, the housing 300 has an air motor compartment 325 for containing an air motor. As known in the art, an air motor has air exhaust vents. The internal walls and ribs of the housing side parts 302 and 308 together define an air flow path 315 for exhaust air to flow from the compartment 325 and downward through the handle 312 to the end wall 288 of the lower ring 282. As shown in FIG. 25, the slots 295 at the top of the lower ring 282 direct the exhaust air to flow radially outward toward the periphery of the end wall 288. The ribs 287 on the upper ring 280 overlie the end wall 288 of the lower ring 282 such that the spaces between the ends of the ribs 287 serve as slots through which the air flows further outward to the periphery of the end wall 288, from which it flows downward into the paint container.

Figure 26:
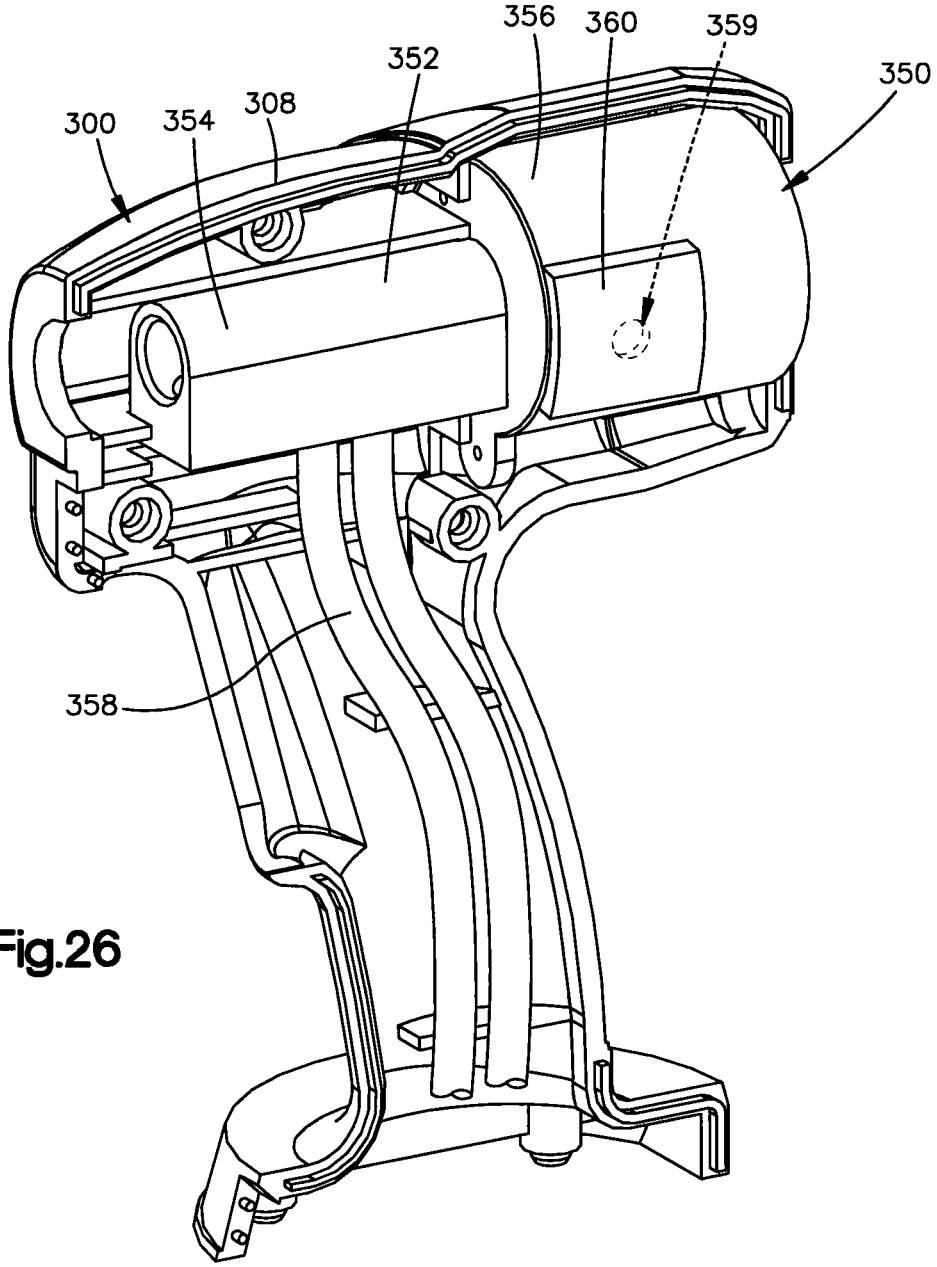
FIG. 26 is a side perspective view of parts of the third embodiment.

FIG. 26 shows an air motor assembly 350 adapted for use with the housing 300 in the third embodiment. This air motor assembly 350 has a housing 352 with a front section 354 and a rear section 356. The front section 354 of the housing 352 contains a pump that has a piston for pumping paint upward through the siphon line 358 and outward through the nozzle 20 (FIG. 1). The rear section 356 contains an air motor with a motor piston that is fixed to the pump piston so that the two pistons reciprocate together under the influence of pressurized air supplied to the air motor.

The rear section 356 of the housing 352 is received in the compartment 325 (FIGS. 23 and 24). A pair of circular exhaust air vent holes 359, one of which is shown in the side perspective view of FIG. 26, are located on opposite sides of the rear portion 354 of the motor housing 352. A pair of air-permeable muffler structures 360 are received over the vent holes 359. Each muffler structure 360, which is preferably formed of felt, is installed under compression between the outer surface of the rear housing portion 354 and the surrounding inner surface of the adjacent side part 302 or 308 of the spray gun housing 300 inside the compartment 325. This helps to muffle the noise generated by exhaust air flowing outward from the vent holes 359 into the compartment 325.

This written description sets forth the best mode of carrying out the invention, and describes the invention so as to enable a person of ordinary skill in the art to make and use the invention, by presenting examples of the elements recited in the claims. The patentable scope of the invention is defined by the claims, and may include other examples that occur to those of ordinary skill in the art. Such other examples are intended to be within the scope of the claims if they have elements that do not differ from the literal language of the claims, or if they have elements with insubstantial differences from the literal language of the claims.

The invention claimed is:

1. An apparatus comprising:

a paint container having an outer diameter;

a paint sprayer assembly including a housing having an air inlet and a nozzle located on the housing;

movable grip members supported on the housing in a circular array having an inner diameter greater than the outer diameter of the paint container; and a ring extending circumferentially about the circular array of grip members, the ring being supported on the housing for rotation relative to the housing, and being configured to move the grip members to a condition in which the inner diameter of the circular array is not greater than the outer diameter of the paint container upon rotation of the ring relative to the housing.

2. An apparatus as defined in claim 1 wherein the ring is configured to move the grip members by deflecting the grip members.

3. An apparatus as defined in claim 1 wherein the ring has cams configured to move circumferentially against the grip members to deflect the grip members radially inward upon rotation of the ring relative to the housing.

4. An apparatus as defined in claim 1 wherein the grip members are supported on the ring in unstressed conditions in which the inner diameter of the circular array is greater than the outer diameter of the paint container, and the ring is configured to deflect the grip members from the unstressed conditions to stressed conditions in which the inner diameter of the circular array is not greater than the outer diameter of the paint container.

5. An apparatus as defined in claim 1 wherein each grip member includes a base and an arm projecting circumferentially from the base to a free end, and the ring is configured to deflect each arm pivotally relative to the respective base upon rotation of the ring relative to the housing.

6. An apparatus as defined in claim 1 wherein the ring is configured to receive the paint container in an installed position reaching axially into the ring.

7. An apparatus as defined in claim 1 wherein the paint sprayer assembly is a hand-held device with a handle and a trigger.

8. An apparatus as defined in claim 1 wherein the paint container is a paint can having an inner rim with a sealing groove configured to receive a sealing bead on a paint can lid.

9. An apparatus comprising:

a paint container having a cylindrical outer surface;

a paint sprayer assembly including a housing having an air inlet and a nozzle located on the housing;

grip members supported on the housing in a circular array configured to surround the cylindrical outer surface of the paint container; and a ring extending circumferentially about the circular array of grip members, the ring being supported on the housing for rotation relative to the housing, and being configured to press the grip members radially inward against the cylindrical outer surface of the paint container upon rotating relative to the housing.

10. An apparatus as defined in claim 9 wherein the ring has cams configured to move circumferentially against the grip members to press the grip members radially inward against the cylindrical outer surface of the paint container upon rotation of the ring relative to the housing.

11. An apparatus as defined in claim 9 wherein each grip member includes a base and an arm projecting circumferentially from the base to a free end, and the ring is configured to deflect each arm pivotally relative to the respective base upon rotation of the ring relative to the housing.

12. An apparatus as defined in claim 9 wherein the ring is configured to receive the paint container in an installed position reaching axially into the ring.

13. An apparatus as defined in claim 9 wherein the paint sprayer assembly is a hand-held device with a handle and a trigger.

14. An apparatus as defined in claim 9 wherein the paint container is a paint can having an inner rim with a sealing groove configured to receive a sealing bead on a paint can lid.

15. An apparatus comprising:

an open can of paint having a cylindrical outer surface and an inner rim with a sealing groove configured to receive a sealing bead on a paint can lid;

a paint sprayer assembly including a housing having an air inlet and a nozzle located on the housing;

grip members supported on the housing in a circular array surrounding the cylindrical outer surface of the open can of paint; and a ring extending circumferentially about the circular array of grip members, the ring being supported on the housing for rotation relative to the housing, and being configured to press the grip members radially inward against the cylindrical outer surface of the open can of paint upon rotating relative to the housing.

16. An apparatus as defined in claim 15 wherein the ring has cams configured to move circumferentially against the grip members to press the grip members radially inward against the cylindrical outer surface of the open can of paint upon rotation of the ring relative to the housing.

17. An apparatus as defined in claim 15 wherein each grip member includes a base and an arm projecting circumferentially from the base to a free end, and the ring is configured to deflect each arm pivotally relative to the respective base upon rotation of the ring relative to the housing.

18. An apparatus as defined in claim 15 wherein the paint sprayer assembly is a hand-held device with a handle and a trigger.

19. An apparatus comprising:

a paint container having an outer diameter;

a paint sprayer assembly including a housing having an air inlet and a nozzle located on the housing; and a pair of concentric rings supported on the housing for rotation relative to each other, with one of the rings having a circular array of deflectable grip members in unstressed conditions in which the circular array has an inner diameter greater than the outer diameter of the paint container, and the other of the rings having cams configured to deflect the grip members from the unstressed conditions to stressed conditions in which the inner diameter of the circular array is not greater than the outer diameter of the paint container upon rotation of the rings relative to each other.

20. An apparatus as defined in claim 19 wherein each grip member includes a base and an arm projecting circumferentially from the base to a free end, and each arm is configured to deflect pivotally relative to the respective base upon rotation of the rings relative to each other.

21. An apparatus as defined in claim 20 wherein one of the rings is configured to receive the paint container in an installed position reaching axially into the ring.

22. An apparatus as defined in claim 19 wherein one of the rings is rotatable relative to the housing and the other of the rings is blocked from rotating relative to the housing.

23. An apparatus as defined in claim 19 wherein the ring having cams is rotatable relative to the housing and the ring having deflectable grip members is blocked from rotating relative to the housing.

24. An apparatus as defined in claim 19 wherein the paint sprayer assembly is a hand-held device with a handle and a trigger.

25. An apparatus as defined in claim 19 wherein the paint container is a paint can having an inner rim with a sealing groove configured to receive a sealing bead on a paint can lid.

26. An apparatus comprising:

a paint container having a cylindrical outer surface;

a paint sprayer assembly including a housing having an air inlet and a nozzle located on the housing;

a first ring supported on the housing, the first ring having grip members and being configured to receive the paint container in an installed position in which the grip members face radially inward toward the cylindrical outer surface of the paint container; and a second ring supported on the housing for rotation relative to the first ring, the second ring having cams configured to press the grip members radially inward against the cylindrical outer surface of the paint container upon rotation of the second ring relative to the first ring when the paint container is in the installed position.

27. An apparatus as defined in claim 26 wherein each grip member includes a base and an arm projecting circumferentially from the base to a free end, and the second ring is configured to deflect each arm pivotally relative to the respective base upon rotation of the second ring relative to the housing.

28. An apparatus as defined in claim 26 wherein the second ring is configured to receive the paint container in the installed position upon movement of the paint container axially into the second ring.

29. An apparatus as defined in claim 26 wherein one of the rings is rotatable relative to the housing and the other of the rings is blocked from rotating relative to the housing.

30. An apparatus as defined in claim 26 wherein the second ring is rotatable relative to the housing and the first ring is blocked from rotating relative to the housing.

31. An apparatus as defined in claim 26 wherein the paint sprayer assembly is a hand-held device with a handle and a trigger.

32. An apparatus as defined in claim 26 wherein the paint container is a paint can having an inner rim with a sealing groove configured to receive a sealing bead on a paint can lid.

* * * * *